US011021872B2

(12) United States Patent
Gosling

(10) Patent No.: US 11,021,872 B2
(45) Date of Patent: Jun. 1, 2021

(54) RECONFIGURABLE WALL HANGER MOUNTING SYSTEM

(71) Applicant: DIRTT Environmental Solutions, Ltd., Calgary (CA)

(72) Inventor: Geoff W. Gosling, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 0 days.

(21) Appl. No.: 16/348,256

(22) PCT Filed: May 30, 2018

(86) PCT No.: PCT/US2018/035177

§ 371 (c)(1),
(2) Date: May 8, 2019

(87) PCT Pub. No.: WO2019/013897

PCT Pub. Date: Jan. 17, 2019

(65) Prior Publication Data

US 2019/0316349 A1 Oct. 17, 2019

Related U.S. Application Data

(60) Provisional application No. 62/531,730, filed on Jul. 12, 2017.

(51) Int. Cl.

| | |
|---|---|
| ***E04B 2/74*** | (2006.01) |
| ***E04B 9/00*** | (2006.01) |
| *E04B 9/06* | (2006.01) |

(52) U.S. Cl.
CPC ..... *E04B 2/7401* (2013.01); *E04B 9/008* (2013.01); *E04B 9/064* (2013.01); *E04B 2002/7483* (2013.01)

(58) Field of Classification Search
CPC . E04B 2/7425; E04B 2/76; E04B 2/72; E04B 2/7407; E04B 2/745;
(Continued)

(56) References Cited

U.S. PATENT DOCUMENTS

| | | | | |
|---|---|---|---|---|
| 4,245,442 A | | 1/1981 | Durham | |
| 4,830,080 A | * | 5/1989 | Densen | A47G 5/00 160/135 |

(Continued)

FOREIGN PATENT DOCUMENTS

| | | | | |
|---|---|---|---|---|
| FR | 2218447 A1 | * | 9/1974 | E04B 2/78 |
| GB | 1013451 A | * | 12/1965 | F16B 5/0052 |

(Continued)

OTHER PUBLICATIONS

International Search Report and Written Opinion from International Patent Application No. PCT/US2018/035177, filed May 30, 2018.

(Continued)

*Primary Examiner* — Babajide A Demuren
(74) *Attorney, Agent, or Firm* — Workman Nydegger

(57) ABSTRACT

A reconfigurable wall hanger mounting system having a plurality of different types of interchangeable wall modules with different types of compatible connection components, each connection component being configured to align with another connection component at an interface. A channel is formed between two connection components in which a support rail or other accessory may be secured to support a ceiling. Another channel is defined by the connection component that can receive other accessories and accessory mounting mechanisms. A door-opening header module may be secured to a connection component so that a flush surface between the support rail, ceiling, and door-opening header module is created across the top of a door-opening in the reconfigurable wall system.

19 Claims, 8 Drawing Sheets

(58) Field of Classification Search
CPC ..... E04B 2002/7461; E04B 2002/7462; E04B 2/7401; E04C 2/46
See application file for complete search history.

(56) References Cited

U.S. PATENT DOCUMENTS

| | | | | |
|---|---|---|---|---|
| 6,260,321 | B1 * | 7/2001 | Rudduck | E06B 1/045 52/474 |
| 9,003,731 | B2 * | 4/2015 | Gosling | E04B 2/745 160/135 |
| 2002/0108330 | A1 | 8/2002 | Yu et al. | |
| 2008/0302054 | A1 * | 12/2008 | Gosling | |
| 2017/0089066 | A1 | 3/2017 | Gosling | |
| 2019/0316349 | A1 | 10/2019 | Gosling | |

FOREIGN PATENT DOCUMENTS

| | | | | |
|---|---|---|---|---|
| GB | 2161846 | A | 1/1986 | |
| WO | WO-2015188105 | A1 * | 12/2015 | E04B 2/7453 |

OTHER PUBLICATIONS

Office Action received for European Patent Application No. 18733075.8, dated Jul. 7, 2020, 4 pages.
Response to EPO Jul. 7, 2020 Office Action in EP Application No. 18733075.8, dated Nov. 16, 2020.
Written Opinion received for SG Application No. 11201904568P, dated Feb. 3, 2021, 5 pages.

* cited by examiner

RECONFIGURABLE WALL HANGER MOUNTING SYSTEM

CROSS-REFERENCE TO RELATED APPLICATIONS

This application is a national stage of International Patent Application No. PCT/US2018/035177 filed on May 30, 2018, which claims the benefit of U.S. Provisional Application No. 62/531,730, titled RECONFIGURABLE WALL HANGER MOUNTING SYSTEM, filed Jul. 12, 2017. The entire content of each of the aforementioned patent applications is incorporated herein by reference.

BACKGROUND

1. The Field

Implementations of the present disclosure relate generally to wall systems, and methods and apparatus for implementing the same, and more particularly to reconfigurable modular wall systems comprising reconfigurable modules, components, and/or design elements, and methods and apparatus for assembling, (re)configuring, and/or using the same.

2. The Relevant Technology

Wall systems, or dividers as they are sometimes called, are used most commonly in an office environment to separate work areas and to give people privacy where permanent walls are lacking, undesirable, or impractical. Previous wall systems have lacked some or all of these attributes. Some are difficult to reconfigure or move without significant amounts of labor and dislocation. Most systems lack the flexibility to quickly and simply change the ordering, orientation, and/or relationship between modular wall components in order to change the aesthetics and/or functionality of an existing wall. Other systems lack the flexibility to use or substitute different types of modular tiles or panels at a designated location or to replace a module in the middle of a wall without taking apart the entire wall. It may be desirable to include door openings, sliding doors, windows, and/or other similar features to an existing wall while maintaining a pleasing aesthetic appearance and proper functionality. It may also be desirable to hang removable accessories on the wall without the need to puncture, nail, or otherwise adhere the accessory to the wall. There also is a need to be able to use the same wall system concepts, components, and connection interface(s) in commercial, residential, industrial and other applications without a system overhaul.

Accordingly, there are advancements that can be made in the area of module walls for hanging accessories.

BRIEF SUMMARY

Implementations of the present disclosure are generally related to wall systems and apparatus, and methods for implementing the same. More specifically, implementations of the present disclosure are directed toward systems and apparatus for implementing a reconfigurable wall hanger mounting system assembly comprising reconfigurable modules, components, and/or design elements, and methods for assembling, (re)configuring, and/or using the same. Some implementations involve wall systems having a plurality of interchangeable wall modules, wherein different types of wall modules have and/or are associated with connection details or components of different shapes and/or types.

Certain implementations relate to systems, methods, and apparatus for connecting, securing, and/or attaching wall modules in a plurality of configurations by means of compatible connection components and/or a common or universal connection interface component.

One embodiment of the reconfigurable wall hanger mounting system includes a plurality of modules having connection components. The connection components are configured to be attached to each other at an attachment interface and include a first accessory channel and at least a portion of a second accessory channel. The first accessory channel is fully defined by one connection component and the second accessory channel is defined by two connection components that have been attached together at the attachment interface.

In another embodiment, a reconfigurable wall system includes a plurality of modules arrangeable into a modular structure. Each module includes first and second connection components attachable to a connection component of another module at an attachment interface. The first connection component includes a first accessory channel and at least a portion of a second accessory channel. The second accessory channel is fully defined by two connection components that have been attached together. The system also includes a support rail secured within at least one of the second accessory channels, a ceiling tile supported by the support rail, and a wall panel secured to one or more of the connection components.

Another exemplary embodiment includes a modular connection component that is reversibly securable to one or more additional modular connection components at an attachment interface to form a modular structure. The modular connection component includes at least one interface element configured to be aligned with a corresponding interface element of a second modular connection component. The modular connection component also includes a first accessory channel and at least a portion of a second accessory channel, where the second accessory channel is fully defined by two modular connection components secured to one another at the attachment interface.

In one embodiment, at least one of the connection components comprises an accessory channel divider between the first and second accessory channels. The accessory channel divider can be rectangular in shape or other shapes depending on the contours of the connection component. The accessory channel divider resides between the first and second accessory channels and at least partially defines both the first and second accessory channels of the connection component.

In one embodiment of the reconfigurable wall hanger mounting system, a support rail with a cantilever arm is secured in the second accessory channel One or more ceiling tiles, ceiling tile beams, or other ceiling components are supported by the support rail.

In one embodiment of the reconfigurable wall hanger mounting system, a door-opening header module may be disposed above a door-opening. The door-opening header module may attach to a connection component at an attachment interface via a connection interface component.

In one embodiment of the reconfigurable wall hanger mounting system, a door-opening is provided. In such an embodiment, the ceiling, support rail, and door-opening header module all lie flush with each other across and above the door opening, creating a smooth, aesthetically pleasing surface across the door-opening of the reconfigurable wall hanger mounting system.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or embodiments thereof which are illustrated in the appended drawings. Understanding that these drawings depict only typical implementations and/or embodiments of the invention and are not therefore to be considered to be limiting of its scope, the invention will be described and explained with additional specificity and detail through the use of the accompanying drawings in which.

DETAILED DESCRIPTION

I. Introduction

Figure 1A:
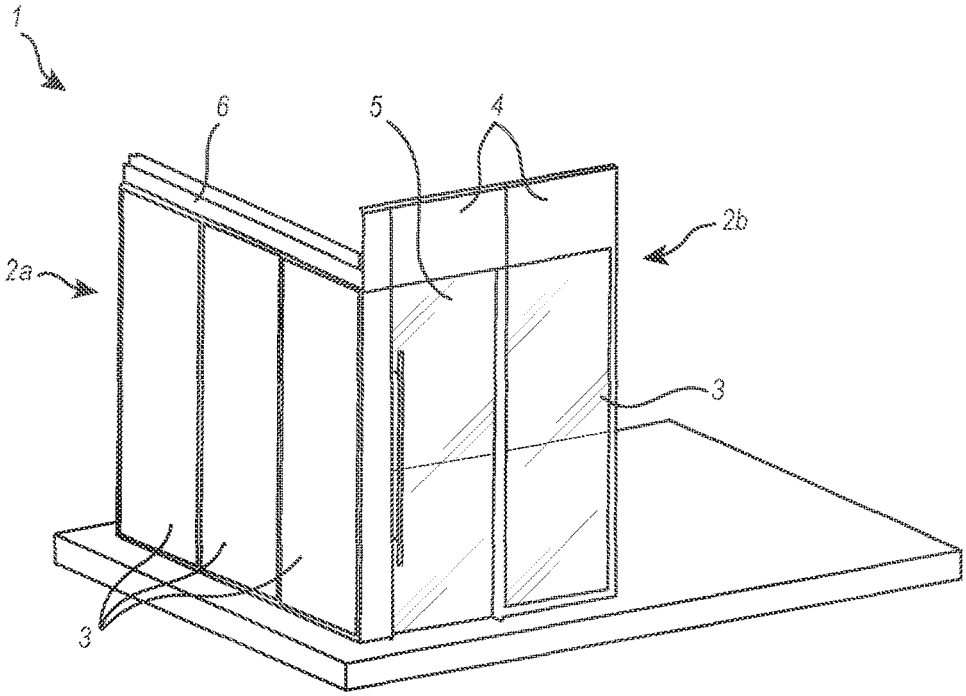
FIG. 1A illustrates a perspective view of a modular wall system including a portion of a single room.

The headings used herein are for organizational purposes only and are not meant to be used to limit the scope of the description or the claims. To facilitate understanding, like reference numerals have been used, where possible, to designate like elements common to the figures.

Implementations of the present disclosure are generally related to wall systems and apparatus, and methods for implementing the same. More specifically, implementations of the present disclosure are directed toward systems and apparatus for implementing a reconfigurable modular wall assembly comprising reconfigurable modules, components, and/or design elements, and methods for assembling, (re) configuring, and/or using the same. Some implementations involve wall systems having a plurality of interchangeable wall modules, wherein different types of wall modules have and/or are associated with connection details or components of different shapes and/or types. Certain implementations relate to systems, methods, and apparatus for connecting, securing, and/or attaching wall modules in a plurality of configurations by means of compatible connection components and/or a common or universal connection interface component.

Accordingly, various implementations of the present disclosure include a reconfigurable modular wall system having a plurality of reconfigurable modules, components, and/or design elements configured for interchangeable attachment one to another. In particular, implementations include a reconfigurable modular wall system having different connection details for common connection of adjacent sections. For instance, certain implementations include a plurality of different connection components respectively having one or more common, universal, and/or compatible connection interfaces and/or connection interface elements or members. Such connection components can allow a user to select a desired module or display element without regard to compatibility concerns as each module and/or connection component(s) thereof are formed, extruded, and/or manufactured so as to be compatible with any other module and/or connection component.

Certain implementations, therefore, may allow a user to reconfigure, reorient, rearrange, and/or replace one or more modules of a wall system without laborious alterations such as, for example: (1) redesigning the entire wall system; (2) changing, altering, and/or swapping connection components; (3) disassembling the entire wall and/or large subsection(s) thereof; and/or (4) requiring additional adapters, components, and/or compatibility elements to ensure proper alignment and/or attachment of the modules. Additionally, some modular wall implementations include door openings, sliding doors, other openings such as windows, and the like.

Likewise, implementations may allow for additional modules and/or accessories to be added to the wall system (e.g., in a vertical and/or horizontal direction) without the requirement of one or more of the aforementioned or other alterations. Thus, implementations of the present disclosure may provide a universally compatible, reconfigurable modular wall system that does not require a pre-designed frame to be constructed prior to assembly of the wall and/or does not require a redesigned frame or subunit in order to change, alter, or otherwise reconfigure the wall or a portion thereof.

Implementations of the present disclosure may also include a common, universal, or multi-compatible connection interface component for securing a plurality of connection components together in a desired configuration, orientation, and/or arrangement. For instance, a universal connection interface component having a substantially X-shaped cross-section may be configured to secure two connection components together at an interface. Specifically, the connection interface component may be inserted, slid, or otherwise positioned into one or more aligned, corresponding, and/or compatible attachment interfaces or other channels in or of the connection component(s) and/or formed at the interface therebetween. For instance, each connection component may include an attachment interface channel extending longitudinally from one end of the connection component to another and/or opposite end of the connection component. Importantly, (i) aligning such attachment interface channels in two or more connection components, and/or (ii) positioning two or more connection components such that corresponding attachment interface channels are aligned, may form a joint and/or shared channel in which a connection interface component may be inserted or otherwise positioned to reversibly and/or selectively secure the connection components together.

Reconfiguration of the modular wall system may, therefore, comprise, involve, and/or include: (1) disengaging and/or slidably or otherwise removing one or more connection interface components from the corresponding attachment interface channels of the connection component(s) (and/or joint or shared channel formed thereby) to release, disconnect, detach, unfasten, or otherwise enable movement of one or more modules from the wall system; (2) removing, reorienting, replacing, and/or reorganizing one or more unsecured modules; and/or (3) re-engaging and/or slidably or otherwise positioning one or more connection interface components into the corresponding attachment interface channels of the connection component(s) (and/or joint or shared channel formed thereby) to secure, attach, connect, or otherwise assemble one or more modules to the wall system.

Various implementations of the present disclosure will now be discussed with reference to the appended drawings. It is appreciated that these drawings depict only typical implementations and are therefore not to be considered limiting in scope.

II. Reconfigurable Wall Hanger Mounting System

FIG. 1A illustrates a modular wall system including a portion of a single room 1. The room 1 includes elements necessary to construct one of a plurality of repeating rooms 1 in a multi-room and/or office space system. The room 1 may include at least two modular walls 2*a*, 2*b*. The walls 2*a*, 2*b* may include a combination of various wall tiles 3, panels 4, and/or doors 5. The room 1 may also include one or more beams 6 disposed above wall 2*a*.

Figure 1B:
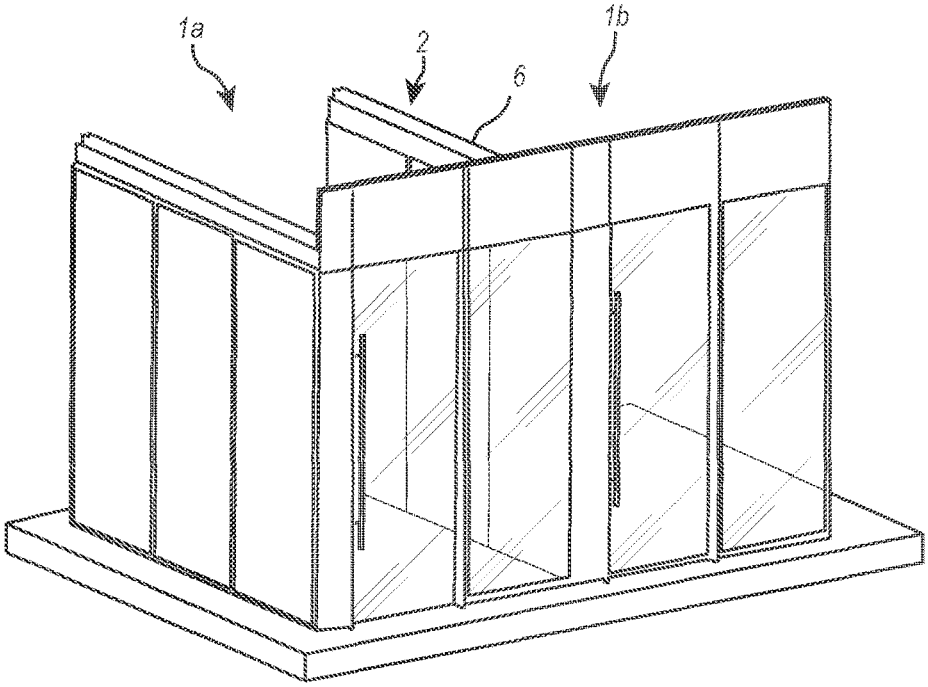
FIG. 1B illustrates a perspective view of a modular wall system including portions of multiple rooms.

FIG. 1B illustrates portions of two rooms 1*a*, 1*b*, each substantially similar to the room 1 illustrated in FIG. 1A, and which may be connected together to form a system of two or more modular rooms. The rooms 1*a*, 1*b* may share at least one common wall 2 and/or beam 6 that may separate the one or more rooms 1*a*, 1*b*. In this way, a plurality of adjacent rooms may be constructed to provide, for example, office spaces. It will be appreciated by one of ordinary skill in the art that any number of combinations and configurations of a modular system of rooms may be constructed in this manner. The rooms 1*a*, 1*b* may be different sizes and shapes, and any number of rooms and/or divided spaces may be attained by varying the location of walls 2, panels 4, and/or doors 5 or other openings.

Figure 2:
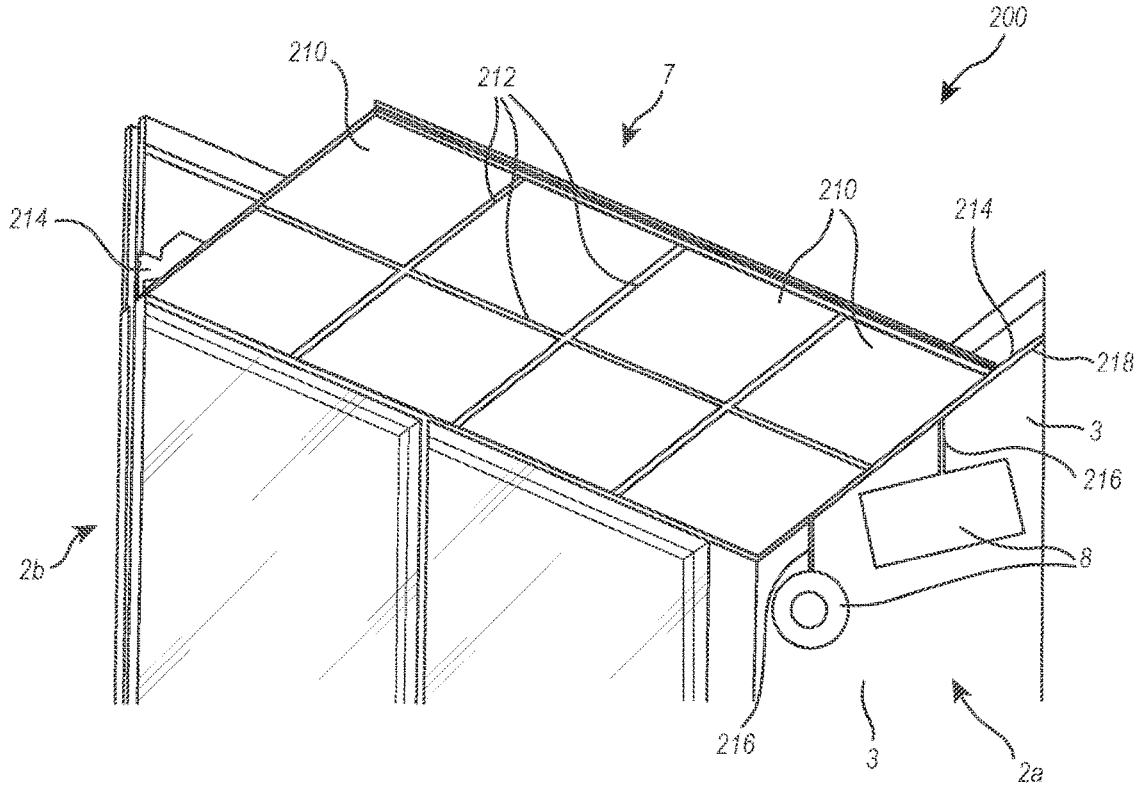
FIG. 2 illustrates a perspective view of a modular wall hanger mounting system.

FIG. 2 illustrates a perspective view of an embodiment of a modular wall system 200 according to the present disclosure from inside the space created by walls 2*a*, 2*b*. In the illustrated embodiment, a modular ceiling 7 spans or is connected between the walls 2*a*, 2*b*, at least partially covering the space created by the walls 2*a*, 2*b*. The ceiling 7 may include various ceiling tiles 210. The ceiling tiles 210 may be supported by one or more ceiling tile beams 212 and/or support rails 214. The ceiling tile beams 212 may also be supported by one or more support rails 214. The support rails 214 will be described in further detail below in reference to FIGS. 5 and 7.

FIG. 2 also illustrates various accessories 8 that may be secured to the wall 2*a* via accessory attachment mechanisms 216. The accessory attachment mechanisms 216 may be secured to the accessories 8 at one end and to one or more connection components (not shown) at the other end. The one or more connection components, to which the various wall panels 3 may be connected, may reside within the modular wall 2*a*. A gap 218 between the wall panel 3 and the support rail 214 may provide an accessory attachment mechanism 216 access to the connection component within the modular wall 2*a*. More detail regarding these components, including the connection components, accessory attachment mechanisms 216, gaps 218, and support rails 214 will be given hereafter in reference to various other figures described herein.

Figure 3A:
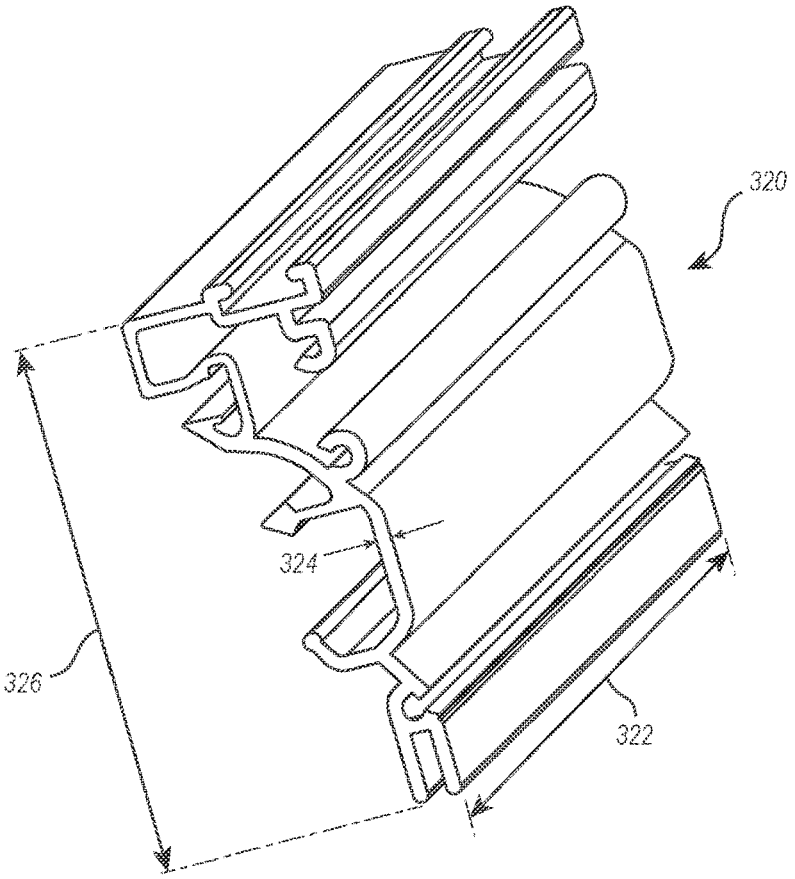
FIG. 3A illustrates a perspective view of an embodiment of a connection component.

FIG. 3A illustrates a perspective view of an embodiment of a connection component 320 according to the present disclosure. The illustrated connection component 320 may be a solid, uniform, unitary, seamless, and/or extruded connection component configured and/or oriented as a lower connection component. One will appreciate in light of the disclosure herein that connection component(s) 320 may be fabricated, manufactured, formed, extruded, and/or comprised of any suitable material, including aluminum, steel, and/or other types of metal and/or metal alloy, as well as any other suitable synthetic and/or natural material, or any suitable combination thereof. Furthermore, multi-component connection component(s) 320 are also contemplated herein.

The connection component 320 illustrated in FIG. 3A has an extrusion length 322. The extrusion length 322 may vary depending on the need and/or configuration of the reconfigurable wall hanger mounting system in which the connection component is employed. The connection component also has a material thickness 324 which may be constant or vary throughout the cross-section and/or length of the connection component 320. Some portions of the connection component 320 may require a greater thickness 324 to accommodate higher stresses and/or stress concentrations due to the connection component 320 geometry and applied loads. Other portions of the connection component 320 may be thinner where lower stresses are present, to reduce material costs, and/or to decrease weight. A total connection component 320 height 326 is also labeled. The height 326 may vary. The height 326, thickness 324, and/or length 322 of the connection component 320 or its individual contours and/or features may vary depending on the requirements of the modular wall system in which it may be employed.

Figure 3B:
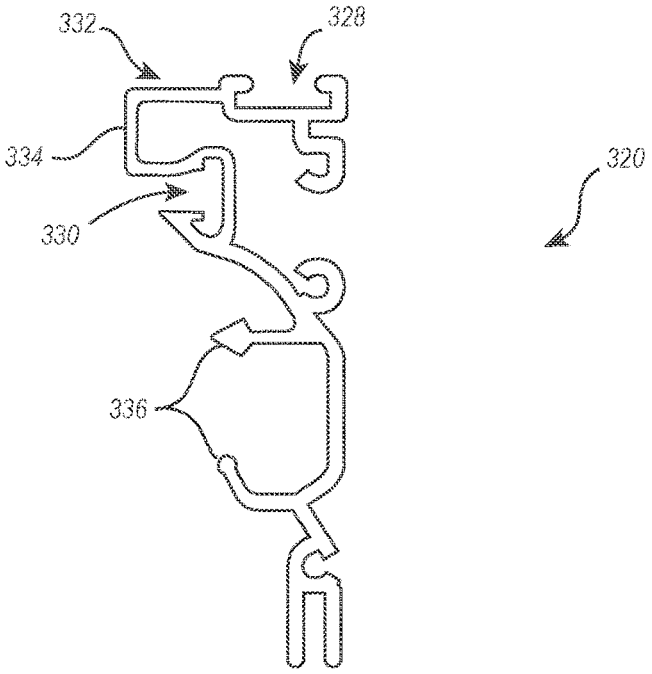
FIG. 3B illustrates a cross-sectional view of the connection component of FIG. 3A.

FIG. 3B illustrates a cross-sectional front view of the connection component 320 illustrated in FIG. 3A. The illustrated embodiment of connection component 320 includes an interface element 328, a first accessory channel 330, a second accessory channel portion 332, an accessory channel divider 334, and one or more attachment elements 336. The attachment elements 336 may be used to attach to modular wall panels, tiles, or other modular wall hanger mounting system components. Further detail will be given regarding attachment elements 336 hereafter.

The first accessory channel 330 may be provided in the connection component 320 defined by the cross-sectional shape and/or contour of the connection component 320. Accessories or accessory mounting mechanisms may be inserted and/or secured in the first accessory channel 330. A portion of a second accessory channel 332 may also be formed by the cross-sectional shape and/or contour of the connection component 320 but may not be fully defined until the connection component 320 has been connected to another connection component (not shown). Further details regarding the second accessory channel 332 will be given hereafter with reference to various other figures.

The accessory channel divider 334 may be a portion of the connection component 320 that resides immediately between the first and second accessory channels 330, 332. In the illustrated embodiment, the accessory channel divider 334 is rectangular in shape. In other embodiments, the accessory channel divider 334 may be other shapes, including circular, polygonal, irregularly shaped, or the like. Some parts of the accessory channel divider 334 may at least partially define the first and/or second accessory channels 330, 332.

Figure 4:
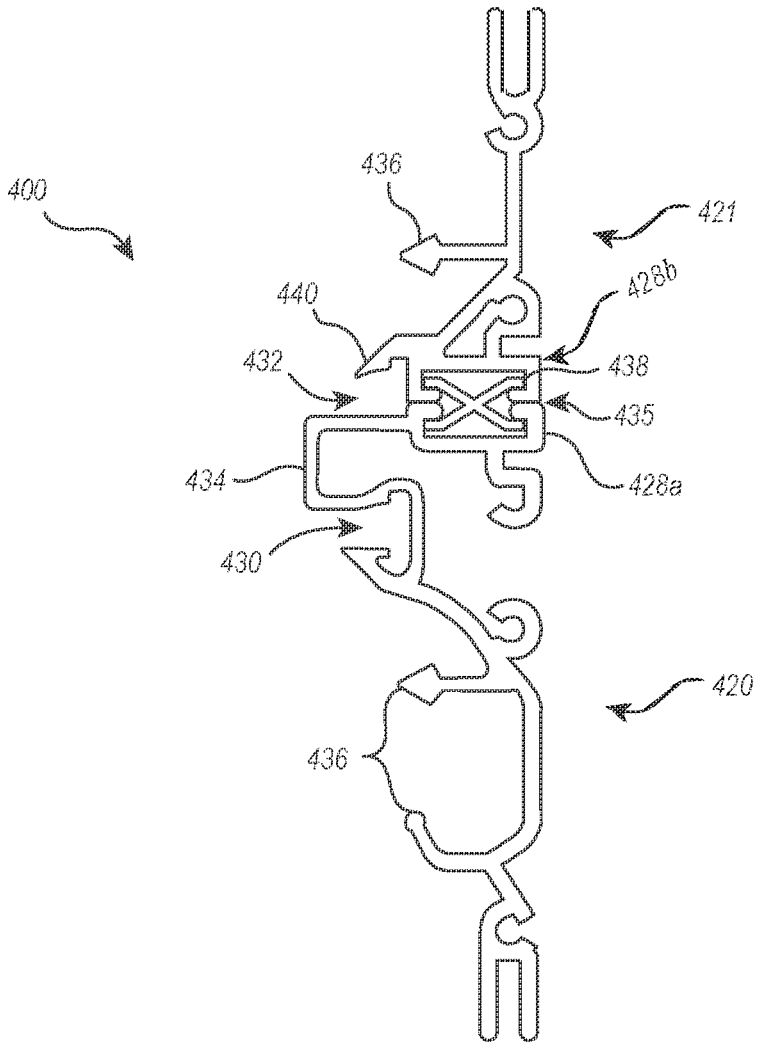
FIG. 4 illustrates a cross-sectional view of a system of two connection components secured at an attachment interface.

FIG. 4 illustrates an assembly 400 of still further components of an embodiment according to one or more implementations of a reconfigurable wall hanger mounting system. In particular, an opposing upper connection component 421 is attached to a respective (opposing) lower connection component 420 (which may be similar or identical to connection component 320) at an attachment interface 435 via a connection interface component 438. The attachment of upper and lower connection components 420, 421 may completely form a second accessory channel 432. A protruding arm 440 of the upper connection component 421, along with adjoined lower and upper interface elements 428*a*, 428*b*, and at least part of the accessory channel divider 434 may fully define the second accessory channel 432. The upper connection component 421 may have other elements that partially define the second accessory channel 432 other than the protruding arm 440 of the illustrated embodiment. Other elements may include, but are not limited to, other protruding arms of different shape and/or contours, an accessory channel divider similar to the accessory channel divider 434 of the lower connection component 420, or the like.

In at least one implementation, connection components 420, 421 may be similar or identical in some or all features and/or elements thereof. For instance, the respective connection components 420, 421 of FIG. 4 have substantially similar configurations in certain features thereof. However, there are some notable differences between the respective connection components 420, 421 of FIG. 4. For instance, the protruding arm 440 of the upper connection component 421 is configured to provide a "hooked" end to partially define the second accessory channel 432, while the accessory channel divider 434 of the lower connection component 420 is configured to provide a "straight" portion of the second accessory channel 432. Also, the upper connection component 421 only has one attachment element 436, while the lower connection component 420 includes two attachment elements 436.

In at least one implementation, connection components 420, 421 can be inverted, interchanged, etc. However, in other implementations, connection components 420, 421 are designated, configured, and/or designed to be assembled, attached, connected, and/or applied as an upper, lower, and/or other connection components 421, 420. In any case, in the system(s) of the present disclosure, first accessory channel 430 may be present on a lower connection component and an upper accessory channel 432 may be defined by the attachment of upper and lower connection components 420, 421 as illustrated in FIG. 4.

Figure 5:
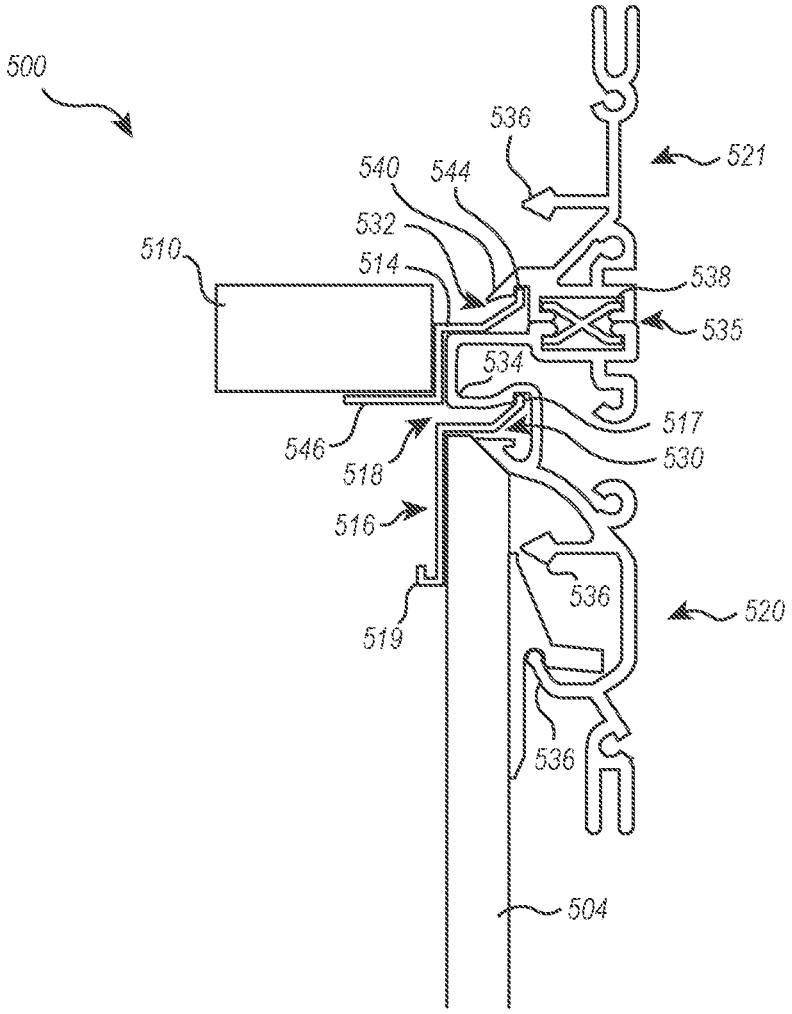
FIG. 5 illustrates a cross-sectional view of an embodiment of a reconfigurable wall hanger mounting system.

FIG. 5 illustrates a cross-sectional view of an assembly 500 of still further components of an embodiment according to one or more implementations of a reconfigurable wall hanger mounting system. The illustrated assembly 500 is a cross-sectional view of a system substantially similar to the modular system illustrated in FIG. 2, wherein accessories 8 may hang on the wall(s) 2. The illustrated embodiment may include upper and lower connection components 521, 520 connected via a connection interface component 538 at an attachment interface 535, a plurality of attachment elements 536, a first accessory channel 530, a second accessory channel 532, one or more support rails 514, and one or more ceiling tiles 510.

The support rail 514 that has been inserted into the second accessory channel 532 may support the ceiling tile 510 and be secured via the support rail cantilever arm 544. An accessory attachment mechanism 516 may be inserted into the first accessory channel 530 via a cantilever arm 517 in a similar fashion as the support rail 514 is secured in the second accessory channel 532. A modular wall panel 504 may be connected to one or more of the connection components 520, 521 via attachment elements 536. One or more tiles and/or panels 504 may be attached or attachable to upper and/or lower attachment elements(s) 536 on one, both, or more sides of the assembly 500.

The support rail 514 may include a cantilever arm 544 and a support arm 546. The support rail 514 may be shaped to coincide with the contour of the accessory channel divider 534 of the connection component 520. In this way, when the cantilever arm 544 of the support rail 514 is inserted into the second accessory channel 532, the support rail 514 may remain in place to support a ceiling tile 510 that may be placed on the support arm 546. The support rail 514 may have other cross-sectional shapes that enable it to be inserted into the second accessory channel 532 and remain in place to support a ceiling tile 510 or other component. This shape may depend on the shape of the accessory channel divider 534, which, although illustrated as rectangular in shape, may be any number of shapes and/or irregularly contoured. The shape of the accessory channel divider 534 may depend on and may be defined by the cross-sectional contour of the connection component 520. The accessory channel divider 534 may also be a protruding arm similar to the protruding arm 540 of the upper connection component 521.

FIG. 5 illustrates the support rail 514 supporting the ceiling tile 510. The support rail 514 may hold a number of other components of a wall hanger system not illustrated in FIG. 5. These other components may include, but are not limited to, ceiling tile beams 212, such as those illustrated in FIG. 2. One will appreciate in light of the disclosure herein that support rail(s) 514 may be fabricated, manufactured, formed, extruded, and/or comprised of any suitable material, including aluminum, steel, and/or other types of metal and/or metal alloy, as well as any other suitable synthetic and/or natural material, or any suitable combination thereof. Furthermore, multi-component support rails 514 are also contemplated herein.

The accessory attachment mechanism 516 includes cantilever arm 517 that may be inserted into the first accessory channel 530 and secured therein to support and/or attach to an accessory at a hook 519. The accessory attachment mechanism 516 may use any number of methods and/or features to attach to an accessory other than a hook 519. Such other features may depend on the accessory being attached thereto, but may include for example clips, ties, adhesives . . . etc. The accessory attachment mechanism 516 is secured to the connection component 520 in the first accessory channel 530 in a similar way in which the support rail 514 is secured in the second accessory channel 532 to support the ceiling tile 510 or other component. Both the support rails 514 and the accessory attachment mechanisms 516 may be inserted into either the first and/or second accessory channels 530, 532 depending on the needs of the reconfigurable wall hanger mounting system.

One will appreciate in light of the disclosure herein that the accessory attachment mechanism(s) 516 may be fabricated, manufactured, formed, extruded, and/or comprised of any suitable material, including aluminum, steel, and/or other types of metal and/or metal alloy, as well as any other suitable synthetic and/or natural material, or any suitable combination thereof. Furthermore, multi-component accessory attachment mechanism(s) 516 are also contemplated herein.

A gap 518 is provided between the wall panel 504 and the ceiling tile 510, support rail 514, and accessory channel divider 534. This gap 518 may provide access for the cantilever arm 517 of the accessory attachment mechanism 516 to be inserted and/or removed from the first accessory channel 530 after a reconfigurable wall hanger mounting system has been assembled.

Figure 6:
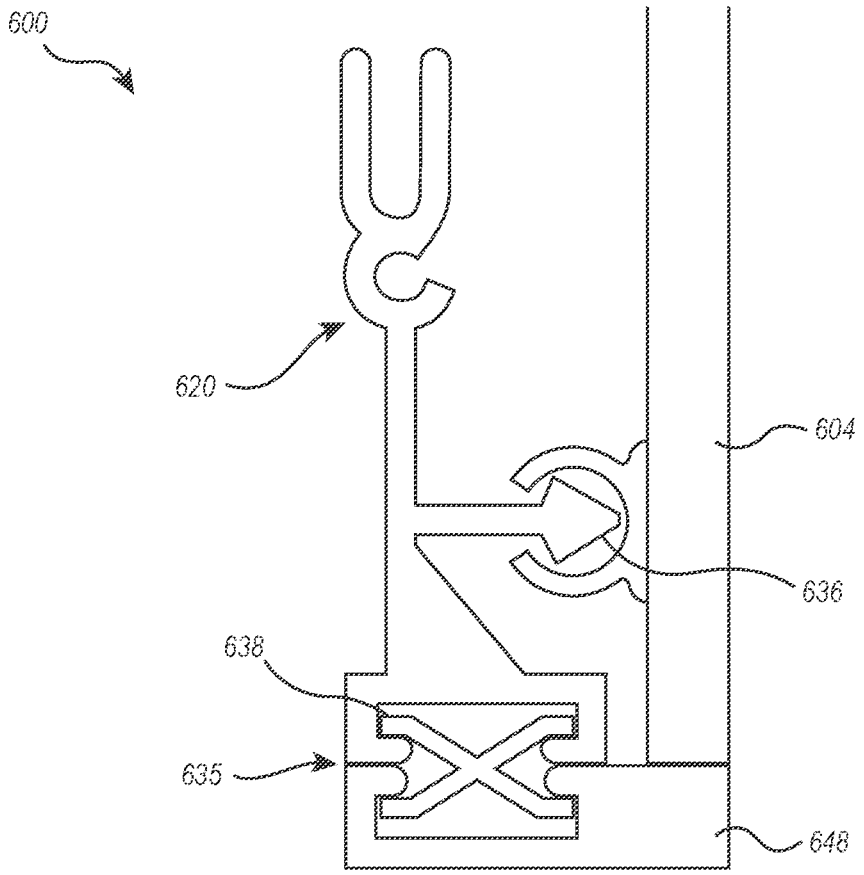
FIG. 6 illustrates a cross-sectional view of an embodiment of a reconfigurable wall system that includes a door-opening header module.

FIG. 6 illustrates a cross-sectional view of an embodiment of a reconfigurable wall system 600 that includes a door-opening header module 648. In one embodiment, the door-opening header module 648 can be combined with a wall hanger mounting system, such as that shown in FIG. 7A. The illustrated embodiment of FIG. 6 includes a door-opening header module 648 connected to a connection component 620 via a connection interface component 638 at attachment interface 635. A modular wall panel 604 may be connected to an attachment element 636 on connection component 620. Other connection components 620, wall panels 604, and/or other system components from other system embodiments described herein may be used in the embodiment illustrated in FIG. 6. For example, the connection components 520, 521 from FIG. 5 may be used to connect the wall panel 604 and/or door-opening header module 648 illustrated in FIG. 6.

Figure 7A:
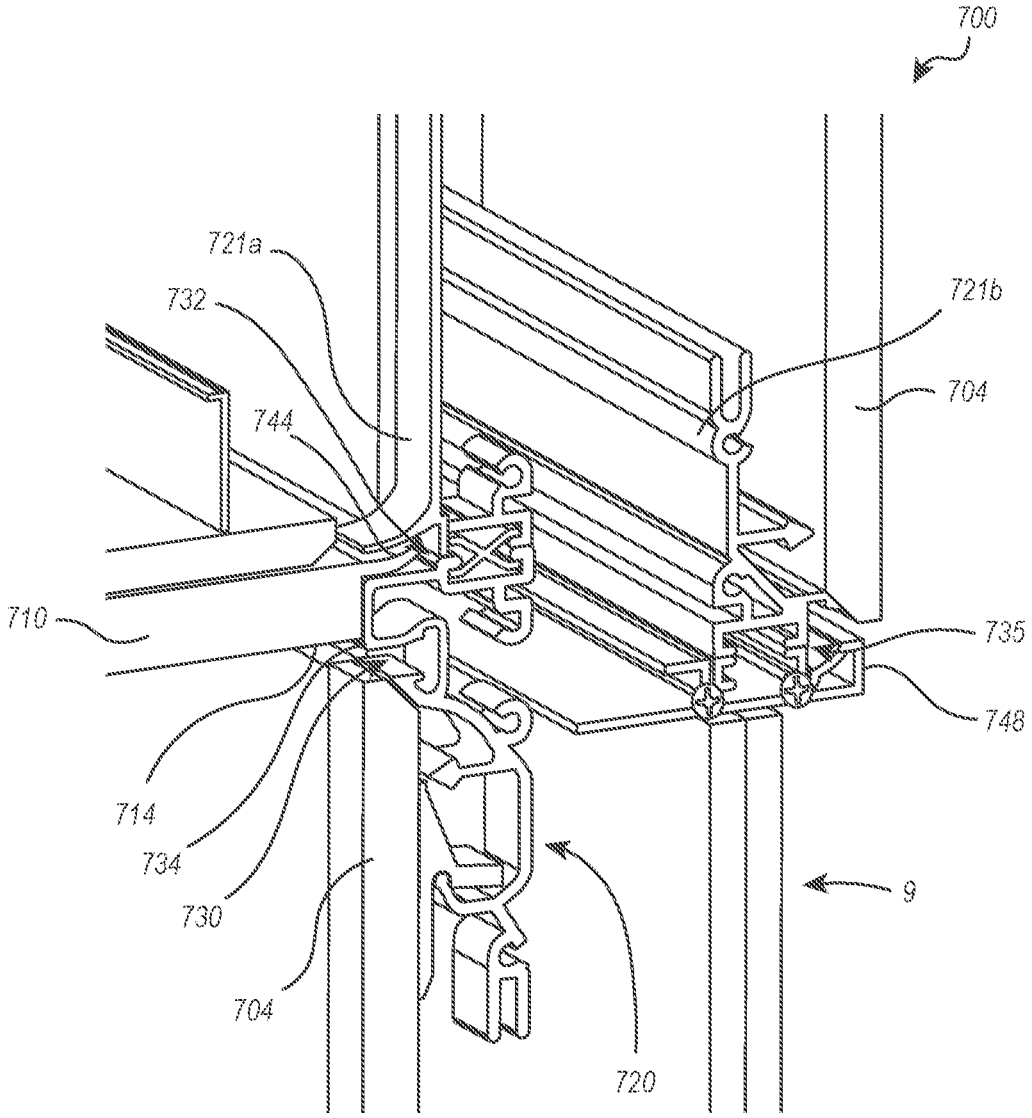
FIG. 7A illustrates a perspective cross-sectional view of a modular wall hanger mounting system including a door opening and a door-opening header module.
Figure 7B:
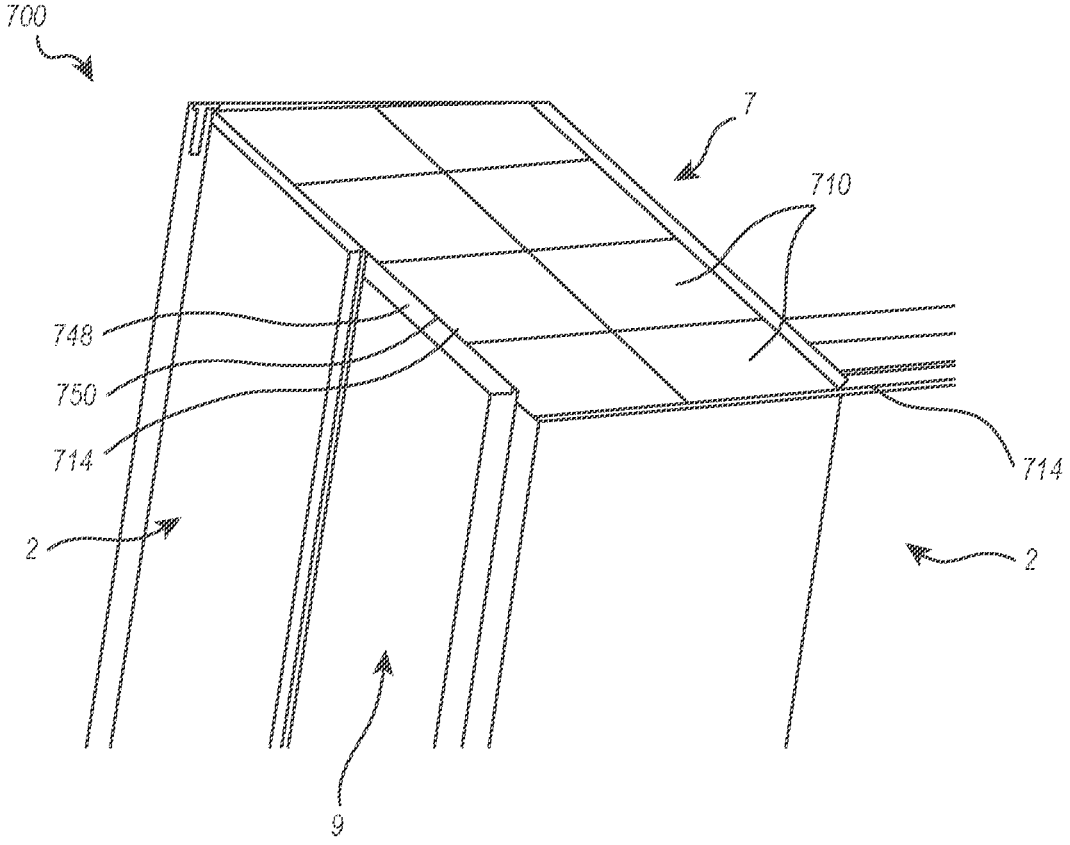
FIG. 7B illustrates a perspective view of the modular wall hanger mounting system of FIG. 7A.

The embodiments of the systems 500, 600, illustrated in FIG. 5 and FIG. 6, or other systems herein illustrated, may be combined within a modular wall 2, such as the system illustrated in FIGS. 7A and 7B. FIG. 7A illustrates an embodiment of a reconfigurable wall hanger mounting system 700 that includes a first upper connection component 721*a*, a lower connection component 720, wall panels 704, a support rail 714 with a cantilever arm 744, a ceiling tile 710, and a door-opening header module 748. The door-opening header module 748 is secured to the second upper connection component 721*b* at an attachment interface 735 and disposed above a door opening 9. The support rail 714 is secured in a second accessory channel 732 defined by upper and lower connection components 721*a*, 720. A first accessory channel 730 is defined by contours of the lower connection component 720. A channel divider 734 is disposed between the first and second accessory channels 730, 732. The channel divider 734 is defined by contours of the lower connection component 720. The channel divider 734 at least partially defines the first accessory channel 730 and the second accessory channel 732.

As illustrated in FIG. 7A, these or other various systems and/or combination of modular systems may be combined so that the ceiling tiles 710, support rails 714, accessory channel divider 734, and door-opening header module 748 all lie flush with each other. The accessory channel divider 734, or lower surface thereof, may also be configured to substantially mimic the rectangular shape of one or more edges of the door-opening header module 748. This configuration results in a continuous, smooth, and aesthetically pleasing look.

FIG. 7B illustrates a perspective view of the reconfigurable wall hanger mounting system 700 from inside the space created by modular walls 2*a*, 2*b*. The illustrated embodiment includes walls 2*a*, 2*b*, a ceiling 7 comprised of a plurality of ceiling tiles 710, one or more support rails 714, a door-opening header module 748, and a door opening 9. A space 750 may also be provided between the support rail 714 and the door-opening header module 748 in which a sliding door or other component may reside. The foregoing description of reconfigurable wall hanger mounting systems, including components such as the connection components, accessory channels, support rails, and other components described herein, may create an aesthetically pleasing, smooth, and/or flush transition between the ceiling tiles 710, ceiling tile beams, spaces 750, and door-opening header modules 748 residing above a door opening 9.

One will appreciate that a wall hanger system 700 according to various implementations of the present disclosure can be oriented in any suitable orientation, including diagonal, vertical or substantially vertical, and/or horizontal or substantially horizontal, wherein the term "substantially" indicates allowable, acceptable, or other deviation(s) from a perfect or other precise orientation. For instance, a substantially vertical orientation can account for small imperfections or errors in the assembly, construction, and/or formation of an upright divider or other wall hanger system 700, including assembling, mounting, constructing, or otherwise assembling the wall hanger system 700.

Furthermore, a plurality of wall modules 2 may be arranged and/or re-arranged into a plurality of configurations resulting in a wall 2 or other barrier, divide, structure or structural component. For instance, the relative positions of walls 2 illustrated in any of the figures described herein may be switched to allow for versatility in aesthetic or other design properties. Indeed, the design and/or components of a reconfigurable hanger wall system may allow for any wall module 2 to be placed, positioned, secured, and/or arranged in any position, orientation, and/or configuration available within the system. For instance, one module may be interchangeable, rearrangeable, and/or replaceable by or with any other module.

The implementations of additional components and/or features known in the art and/or desirable in certain implementations of the present disclosure will be apparent to those skilled in the art and/or in light of the present disclosure. For instance, certain implementations may include acoustic and/or other tiles or panels mounted to, about, and/or within components, modules, subunits, walls, and/or systems disclosed herein. Furthermore, the absence of such known or apparent features should not be construed as restricting the scope or application of the present disclosure to the exclusion of such features.

Where appropriate, "substantially" can imply less than 10%, less than 1%, less than 0.1%, or less than 0.01% variability or error relative to a perfect or precise orientation. Thus, diagonal orientations comprise those orientations that are neither vertical or substantially vertical, nor horizontal or substantially horizontal.

III. Method of Configuring a Reconfigurable Wall Hanger Mounting System

In at least one implementation, a method of assembling a wall system comprises providing a plurality of modules configured to be arranged into a modular structure, wherein each module comprises at least one connection component configured to be attached to a connection component of another module. Some methods can also include aligning a connection component of a first module with a connection component of a second module at a connection interface. Furthermore, implementations can include reversibly securing the first module to the second module by means of a connection interface member.

In some implementations, the connection component of the first module comprises an interface channel that aligns at the connection interface with a corresponding interface channel of the connection component of the second module. The method can also include reversibly securing the first module to the second module by inserting the connection interface member into the respective interface channels of the respective connection components of the first and second modules such that the respective interface channels remain aligned while the connection interface member that is at least partially positioned therein.

In an implementation, at least the first module comprises first and second connection components positioned on opposite ends of the first module. Moreover, at least the first module can include a tile attached to the connection component of the first module, wherein the tile comprises at least one of a transparent material, a translucent material, and an opaque material. In addition, the first module can comprise one or more frame elements attached to one or more of the connection component, the tile, and a tile attachment member. In at least one implementation, the tile is attached to and positioned between first and second connection components positioned on opposite ends of the module. The method may also include attaching one or more frame elements to the first module, wherein the one or more frame elements are configured to support the modules.

In another implementation, an opening in the modular wall may be provided by adding doorframe elements and/or door-opening header elements to the connection component of the first module. Ceiling tiles may also be added to span a space between two or more walls by inserting support rails and/or other elements to the connection components of the modular walls near the top of the walls. The support rails may be inserted and/or secured to the connection components by inserting the support rail cantilever arm(s) into one or more accessory channels of the connection components. The ceiling tiles or other ceiling components may then be placed on the support rails. Other accessories, such as pictures, plant hangers, or other accessories may also be secured in a similar manner as the support rails using additional accessory channels provided in the connection components. Cantilever arms or other accessory attachment mechanisms may be inserted into these other accessory channels to secure additional accessories. These additional accessory channels may be accessed, even after a complete installation of a modular wall and accompanying tiles and/or other modules, through a gap provided above a wall tile but below a ceiling tile and/or associated support rail.

The above-described implementations of the present disclosure are meant to be illustrative of preferred implementations and are not intended to limit the scope of the present disclosure. Various modifications, which would be readily apparent to one skilled in the art, are intended to be within the scope of the present disclosure. The only limitations to the scope of the present disclosure are set forth in the following claims appended hereto.

While various aspects and implementations have been disclosed herein, other aspects and implementations are contemplated. The various aspects and implementations disclosed herein are for purposes of illustration and are not intended to be limiting. Thus, while the foregoing is directed to certain implementations of the present disclosure, other and further implementations of the disclosure may be devised without departing from the basic scope thereof. In addition, implementations of the present disclosure are further scalable to allow for additional components, modules, subunits, systems, elements, members, and/or users, etc., as particular applications may require.

It is also understood that various implementations described herein may be utilized in combination with any other implementation described, without departing from the scope contained herein. Therefore, products, members, elements, devices, apparatus, systems, methods, and/or processes according to certain implementations of the present disclosure may include, incorporate, or otherwise comprise properties, features, components, members, elements, steps, and/or the like described in other implementations (including systems, methods, apparatus, and/or the like) disclosed herein without departing from the scope of the present disclosure. Thus, reference to a specific feature in relation to one implementation should not be construed as being limited to applications only within said implementation.

As used throughout this application the word "may" is used in a permissive sense (i.e., meaning having the potential to), rather than the mandatory sense (i.e., meaning must). Similarly, the words "include", "including", and "includes" mean including but not limited to. Additionally, the words "including," "having," "involving" and variants thereof (e.g., "includes," "has," and "involves") and/or the like, as used herein, including the claims, shall be open ended and have the same meaning as the word "comprising" and variants thereof (e.g., "comprise" and "comprises").

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached invention disclosure for purposes of illustrating the invention, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

I claim:

1. A reconfigurable wall system comprising:

a module configured to be arranged into a modular structure, wherein the module comprises a connection component configured to be attached to a corresponding connection component of a different module at an attachment interface, the connection component comprising:

a first accessory channel disposed within the connection component, wherein the first accessory channel is configured to receive and secure a cantilever arm from a lateral side of the connection component; and a portion of a second accessory channel disposed on the connection component and adjacent to the attachment interface, the second accessory channel being:

defined by the portion of the second accessory channel and a corresponding portion of the second accessory channel of the corresponding connection component secured to the connection component at the attachment interface, and configured to receive and secure a cantilever arm from the lateral side of the first connection component, wherein a cantilever arm of an accessory attachment mechanism extends into the first accessory channel and a cantilever arm of a support rail extends into the second accessory channel.

2. The system of claim 1, wherein the first accessory channel of the connection component is defined by a contour of the connection component.

3. The system of claim 1, wherein the connection component comprises an accessory channel divider residing immediately between the first accessory channel and the portion of the second accessory channel, the accessory channel divider at least partially defining the first accessory channel and the portion of the second accessory channel.

4. The system of claim 3, wherein the accessory channel divider is rectangular in shape.

5. The system of claim 3, wherein the accessory channel divider defines a flat surface within the second accessory channel, the flat surface being configured to support an extension of the cantilever arm of the support rail.

6. The system of claim 5, wherein the support rail is configured to support at least one modular ceiling tile.

7. A reconfigurable wall system comprising:

a plurality of modules configured to be arranged into a modular structure, wherein each module comprises a first connection component and a second connection component, wherein:

each first connection component is configured to be attached to a separate second connection component of a separate module at a first attachment interface, each second connection component is configured to be attached to a separate first connection component of a separate module at a second attachment interface, and at least one first connection component comprises:

a first accessory channel defined by contours of the at least one first connection component, wherein the first accessory channel is configured to receive and secure a cantilever arm from a lateral side of the at least one first connection component; and a portion of a second accessory channel, the second accessory channel being fully defined by the portion of the second accessory channel and a corresponding portion of the second accessory channel of a separate second connection component of a separate module secured to the at least one first connection component, wherein the second accessory channel is configured to receive and secure a cantilever arm from the lateral side of the at least one first connection component;

a support rail securable within the second accessory channels;

a ceiling tile supportable by the support rail; and a wall panel securable to the at least one first connection components.

8. The system of claim 7, further comprising a door-opening header module configured to be secured to at least one second connection component.

9. The system of claim 8, wherein the door-opening header module is disposed above a door-opening, and wherein the ceiling tile is substantially flush with the door opening header module.

10. The system of claim 7, wherein the support rail includes a cantilever arm configured to extend into the second accessory channel, the cantilever arm securing the support rail to the second accessory channel of the at least one connection component.

11. The system of claim 8, wherein the door-opening header module is attached to the separate second connection component via a connection interface component at the separate second connection component attachment interface.

12. The system of claim 7, wherein a gap resides between the wall panel and the ceiling tile, wherein the gap is configured to allow access into the first accessory channel by an accessory attachment mechanism.

13. A modular connection component configured to be reversibly secured to one or more additional modular connection components at an attachment interface to form a modular structure, the modular connection component comprising:

at least one interface element configured to be aligned with a corresponding interface element of a second modular connection component;

a first accessory channel configured to receive and secure a first cantilever arm from a lateral side of the modular connection component;

a portion of a second accessory channel configured to receive and secure a second cantilever arm from the lateral side of the modular connection component, wherein the second accessory channel is fully defined by the portion of the second accessory channel and a corresponding portion of the second accessory channel of an additional modular connection component secured to the modular connection component at the attachment interface; and an accessory channel divider at least partially defining the portion of the second accessory channel, the accessory channel divider comprising a contoured shape configured to support an extension of the second cantilever arm.

14. The modular connection component of claim 13, wherein a portion of the contoured shape of the accessory channel divider defines a flat surface within the second accessory channel, the flat surface being configured to support the extension of the second cantilever arm.

15. The modular connection component of claim 13, wherein the accessory channel divider resides immediately between the first accessory channel and the portion of the second accessory channel.

16. The modular connection component of claim 13, wherein the accessory channel divider at least partially defines the first accessory channel and the portion of the second accessory channel.

17. The modular connection component of claim 13, wherein the accessory channel divider is rectangular in shape.

18. The modular connection component of claim 13, further comprising at least one attachment element configured to attach to one or more modular wall panels.

19. The modular connection component of claim 18, wherein the first accessory channel and the portion of the second accessory channel reside above the at least one attachment element.

* * * * *